US006291782B1

(12) United States Patent
Isikawa

(10) Patent No.: US 6,291,782 B1
(45) Date of Patent: Sep. 18, 2001

(54) MULTI-DIRECTIONAL INPUT DEVICE

(75) Inventor: Shinzi Isikawa, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/624,882

(22) Filed: Jul. 24, 2000

(30) Foreign Application Priority Data

Jul. 27, 1999 (JP) ..... 11-212621
Aug. 5, 1999 (JP) ..... 11-222026

(51) Int. Cl.[7] ..... H01H 19/20
(52) U.S. Cl. ..... 200/14; 200/4; 200/18
(58) Field of Search ..... 200/4, 5 R, 6 R, 200/8 R, 9, 11 R–11 TW, 17 R, 520, 521, 537, 564, 567, 329, 336, 341, 61.54

(56) References Cited

U.S. PATENT DOCUMENTS 5,593,023 * 1/1997 Kaizaki et al. ..... 200/570
5,613,600 * 3/1997 Yokoji et al. ..... 200/564
5,705,778 * 1/1998 Matsui et al. ..... 200/11 R
5,847,335 * 12/1998 Sugahara et al. ..... 200/4
5,886,310 * 3/1999 Kataoka et al. ..... 200/14
5,959,267 * 9/1999 Kawasaki et al. ..... 200/4
6,100,480 * 8/2000 Takahashi ..... 200/330

FOREIGN PATENT DOCUMENTS 7-27605 6/1995 (JP) ..... H01C/10/16
7-31470 7/1995 (JP) ..... H01H/19/00
10-255596 9/1998 (JP) ..... H01H/25/06

* cited by examiner

*Primary Examiner*—Michael Friedhofer
(74) *Attorney, Agent, or Firm*—Brinks Hofer Gilson & Lione

(57) ABSTRACT

A multi-directional input device according to the present invention is operated by the movement in the axial direction of an operation member, and a push-switch generating an electrical signal is arranged at an end of the operation member in the axial direction, thereby reducing the dimension in the thickness direction to obtain a thin multi-directional input device.

14 Claims, 8 Drawing Sheets

MULTI-DIRECTIONAL INPUT DEVICE

BACKGROUND OF THE INVENTION

1. Field of the Invention

The present invention relates to a multi-directional input device suitable for use in portable telephones and the like.

2. Description of the Related Art

A conventional multi-directional input device will be described with reference to FIGS. 13 to 15. This multi-directional input device is provided with a shaft 52 disposed at one end of a box-shaped casing member 51 formed of synthetic resin moldings and a rotary electrical element 53 generating an electrical signal of a pulse signal. (rotational quantity signal) attached to the shaft 52.

A driving body 54 formed of synthetic resin moldings and accommodated within the casing member 51 is provided with a pair of supporting walls 54*a* having a spacing therebetween. Sleeve-like bearings 56 press-fitted into both ends of a roller-like operating member 55 are rotatably attached to the pair of supporting walls 54*a* so that the operating member 55 is rotatable.

The shaft 52 is inserted into non-circular holes 56*a* formed in the center of one of the bearings 56, so that the rotary electrical element 53 is operative by the rotation of the shaft 52 via the bearings 56 during the rotation of the operating member 55 while the driving member 54 is movable in the axial direction by using the casing member 51 and the shaft 52 as guides thereof when the operating member 55 is moved in the axial direction.

A sliding type electrical element 58 comprising a variable resistor and having a sliding portion 57 is attached directly beneath the casing member in a pile, so that the sliding portion 57 is inserted into a hole 54*b* of the driving body 54.

This sliding type electrical element 58 detects positional information in response to the displacement.

First and second driving plates 59 and 60 respectively having rectangular holes 59*a* and 60*a* formed at the centers thereof are arranged to be overlaid on each other while the sliding portion 57 is inserted into the holes 59*a* and 60*a*.

Between the first driving plate 59 and the casing member 51, a spacer 61 is arranged. Springs 62 and 63 are respectively strung between the first driving plate 59 and the casing member 51 and between the second driving plate 60 and the casing member 51 to thereby pull the sliding portion 57 in the neutral state.

Next, operation of such a conventional multi-directional input device will be described. When the operating member 55 is moved in the direction of the arrow "X1", the driving member 54 moves against the spring 62 together with the sliding portion 57 and the first driving plate 59 to thereby operate the sliding type electrical element 58; when the operation of the operating member 55 is cancelled from this state, the first driving plate 59, the driving member 54, and the operating member 55 are returned to the original neutral position by the spring 62.

Then when the operating member 55 is moved in the direction of the arrow "X2", the driving member 54 moves against the spring 63 together with the sliding portion 57 and the second driving plate 60 to thereby operate the sliding type electrical element 58; when the operation of the operating member 55 is cancelled from this state, the second driving plate 60, the driving member 54, and the operating member 55 are returned to the original neutral position by the spring 63.

By operating the operating member 55 in the axial direction in such a manner, positional information is detected in response to the displacement so as to determine a frame advancing speed of images or the like.

Next, when the operating member 55 is rotated, the rotary electrical element 53 is operated via the bearings 56 and the shaft 52 so as to generate a rotational quantity signal.

Consequently, frame advance can be performed according to the speed determined by the movement in the axial direction.

In the conventional multi-directional input device, since the sliding type electrical element 58 generating an electrical signal is arranged beneath the casing member 51, there is a problem in that the thickness is increased so that a thin shape is difficult to be achieved.

There is also another problem in that the number of parts is increased because the driving body 54, the first and second driving plates 59 and 60, and two springs 62 and 63 are necessary for operating the sliding type electrical element 58, resulting in the increased cost and low productivity.

SUMMARY OF THE INVENTION

Accordingly, it is an object of the present invention to provide a multi-directional input device which is suitable for making it thinner while being inexpensive and having improved efficiency of assembly work.

In accordance with a first aspect of the present invention, there is provided a multi-directional input device comprising: a casing member; a roller-like operating member, which is rotatable and movable in the axial direction and supported by the casing member; a rotary electrical element, which is generating an electrical signal and operated by rotation of the operating member; and a push-switch operated by the movement in the axial direction of the operating member, wherein the rotary electrical element and the push-switch are arranged at ends of the operating member in the axial direction.

Preferably, the operating member comprises an operating portion disposed in the center and a shaft provided at an end of the operating member so that the operating member is rotatably held at the shaft by the casing member while the rotary electrical element and the push-switch are operated via the shaft.

Preferably, the operating portion is arranged nearer to the rotary electrical element than to the push-switch.

Preferably, the casing member is provided with a bottom wall to which the push-switch is attached.

Preferably, an L-shaped movable member having a first and a second arm is rotatably held so that the shaft urges the first arm so as to rotate the movable member and the push-switch is operated with the second arm by the rotation of the movable member.

Preferably, the push-switches are respectively arranged at both ends of the operating member so that the push-switches are respectively operated by the movement in the axial direction of the operating member.

Preferably, a multi-directional input device further comprises a switch for detecting the rotational direction operated by the rotation of the operating member, wherein the switch is arranged at one end of the operating member while the rotary electrical element is arranged at the other end of the operating member.

In accordance with a second aspect of the present invention, there is provided a multi-directional input device comprising: a casing member; a shaft; an operating member rotatably attached to the casing member; a rotary electrical element generating an electrical signal by rotation of the operating member; a rotating member held by the shaft and formed to rotate together with the shaft by frictional force during the rotation of the shaft due to the rotation of the operating member and to be stopped from rotating by a stopper so as to cause the shaft to race after rotating together therewith at a predetermined angle; a switch formed of a movable contact provided in the rotating member and a fixed contact attached to the casing member; and a push-switch, wherein after the movable contact switches the fixed contact by the rotation of said rotating member in the normal or reverse direction when the operating member is rotated in the normal or reverse direction, the rotating member abuts the stopper to thereby operate the switch so that the rotating member stops rotating and the operating member starts to race, wherein the rotary electrical element is operated to generate an electrical signal by rotation of the operating member, and wherein the push-switch is arranged at an end of the operating member in the axial direction so that the push-switch is operated to generate an electrical signal by the movement of the operating member in the axial direction.

Preferably, the stopper is formed in the casing member.

Preferably, a concave portion is formed in the casing member to form the stopper therein while a convex portion is formed in the rotating member to cause the convex portion to abut part of the concave portion so as to stop the rotation of the rotating member.

Preferably, a multi-directional input device further comprises a supporting member made of an insulating material and provided with the fixed contact, wherein the fixed contact is attached to the casing member by attaching the supporting member to the casing member.

Preferably, the stopper is formed in the supporting member.

Preferably, a concave portion is provided in the supporting member to form the stopper while a convex portion is provided in the rotating member so that rotation of the rotating member is stopped by abutting of the convex portion to part of the concave portion.

Preferably, a multi-directional input device further comprises an elastic member, wherein frictional force between the rotating member and the operating member is applied by the elastic member.

Preferably, a multi-directional input device further comprises a movable contact plate formed of one metallic plate and provided with the movable contact, wherein the rotating member is formed of the movable contact plate.

Preferably, the operating member comprises a roller-like operating portion disposed in the center of the operating member and the shafts disposed at both ends of the operating member, the rotary electrical element being arranged at one of the shafts while the switch being arranged at the other shaft.

DESCRIPTION OF THE PREFERRED EMBODIMENT

Figure 1:
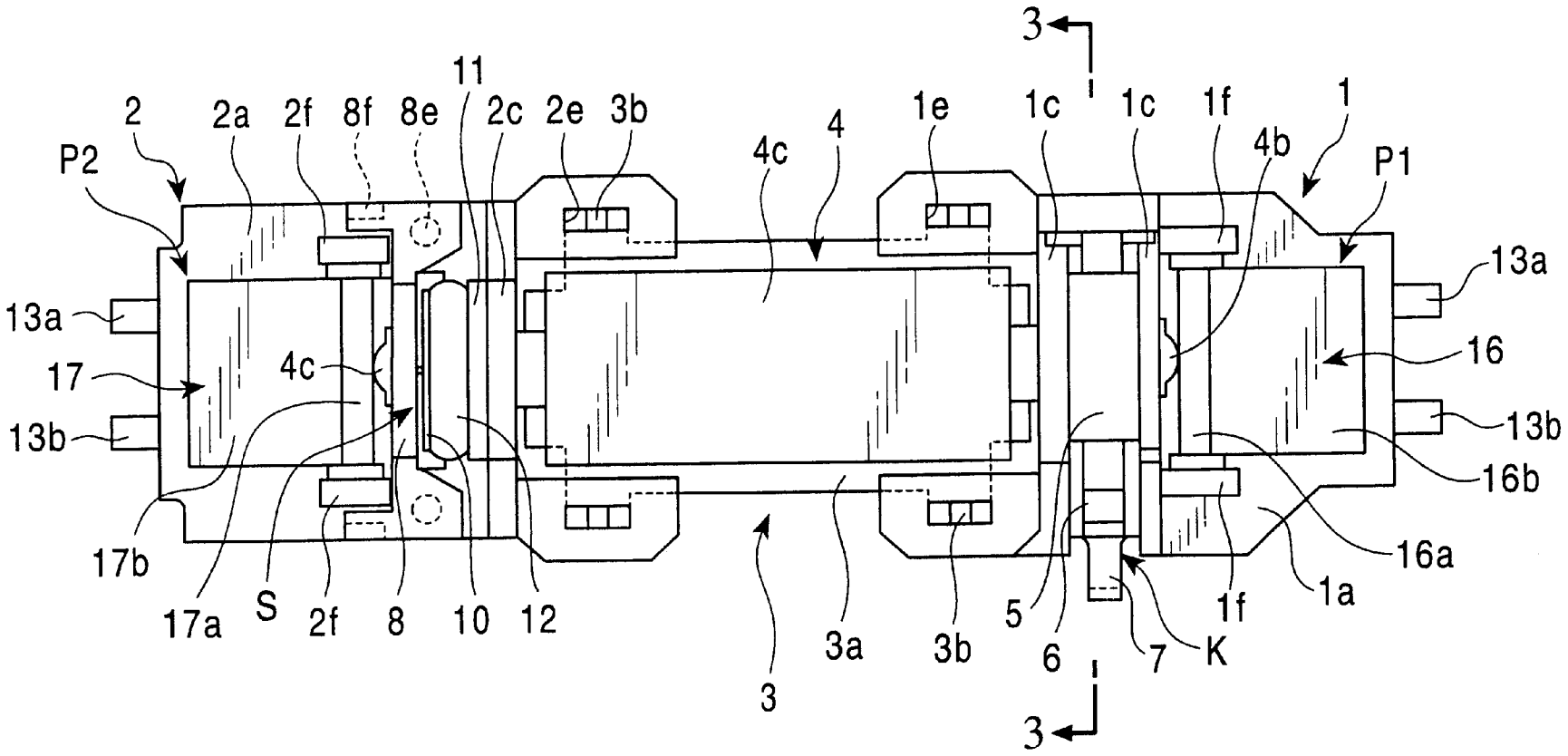
FIG. 1 is a plan view of a multi-directional input device according to the present invention.
Figure 2:
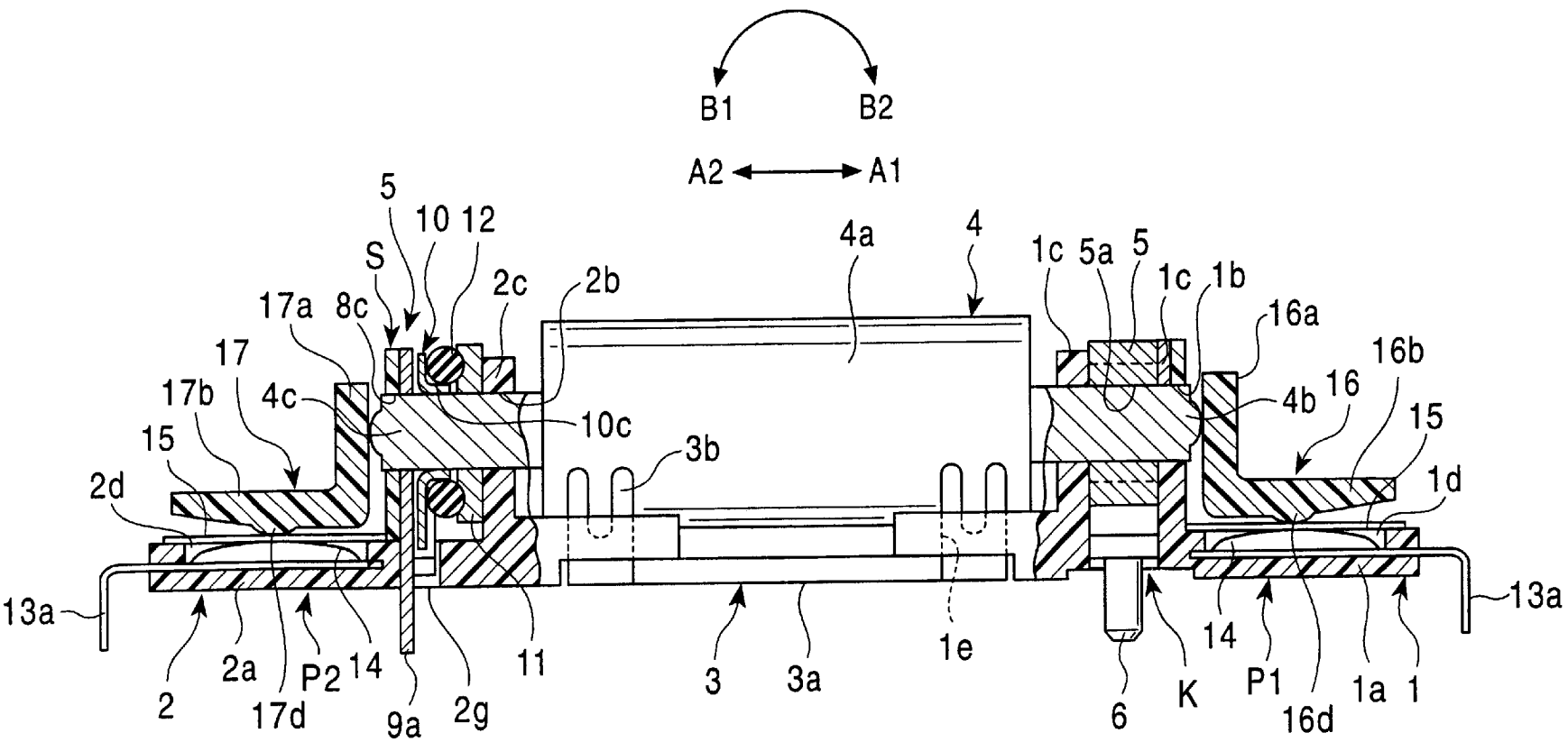
FIG. 2 is a sectional view of an essential part of the multi-directional input device according to the present invention.
Figure 3:
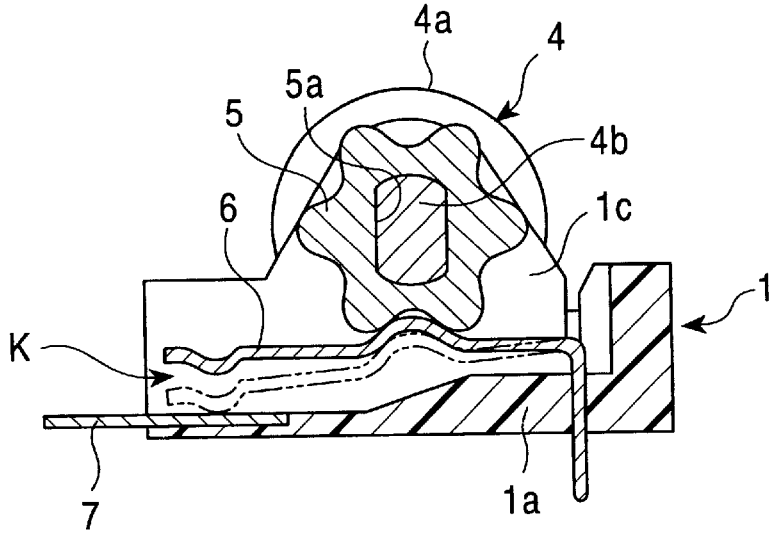
FIG. 3 is a sectional view at the line 3—3 of FIG. 1.
Figure 4:
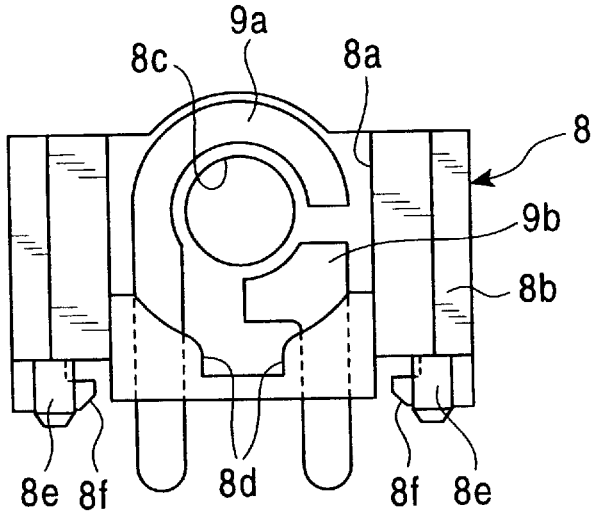
FIG. 4 is a front view of a supporting member of the multi-directional input device according to the present invention.
Figure 5:
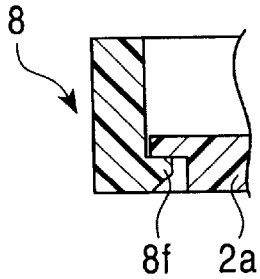
FIG. 5 is a sectional view of an essential part in the attached state of the supporting member of the multi-directional input device according to the present invention.
Figure 6:
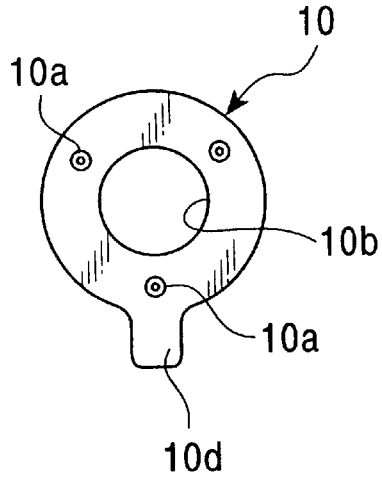
FIG. 6 is a front view of a rotating member of the multi-directional input device according to the present invention.
Figure 7:
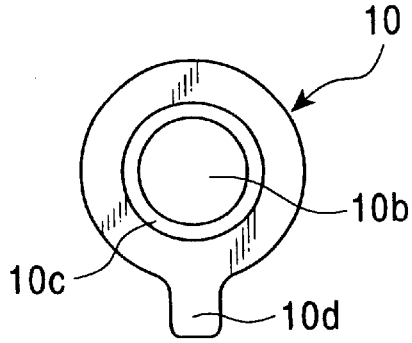
FIG. 7 is a backside view of the rotating member of the multi-directional input device according to the present invention.
Figure 8:
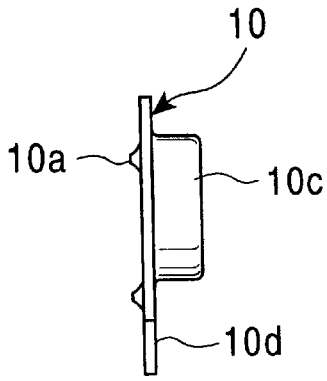
FIG. 8 is a side view of the rotating member of the multi-directional input device according to the present invention.
Figure 9:
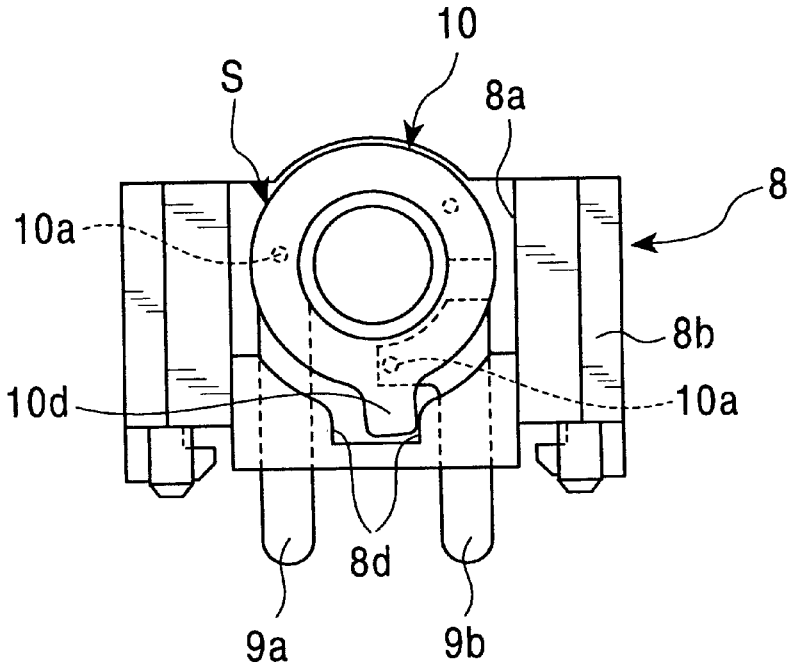
FIG. 9 is a schematic representation showing relationship during the normal rotation between the supporting member and the rotating member of the multi-directional input device according to the present invention.
Figure 10:
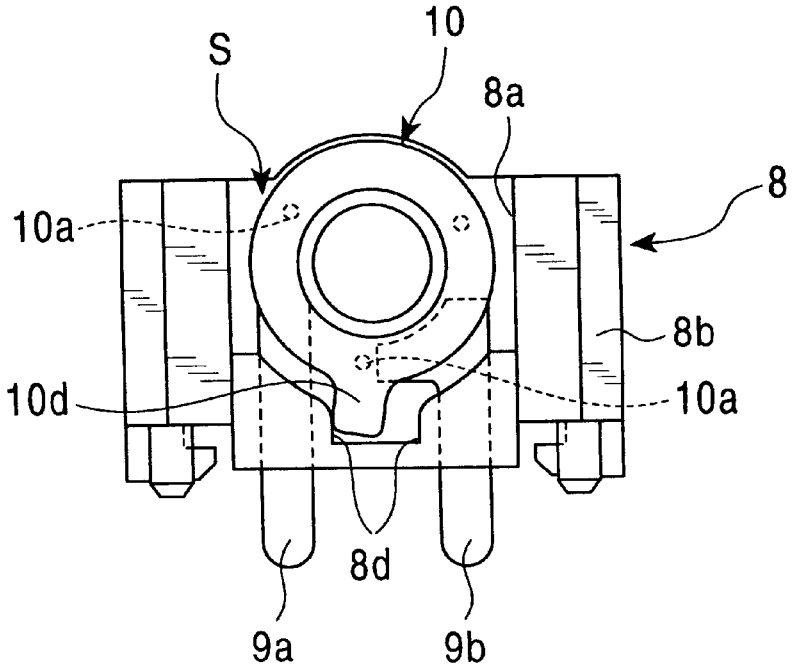
FIG. 10 is a schematic representation showing relationship during the reverse rotation between the supporting member and the rotating member of the multi-directional input device according to the present invention.
Figure 11:
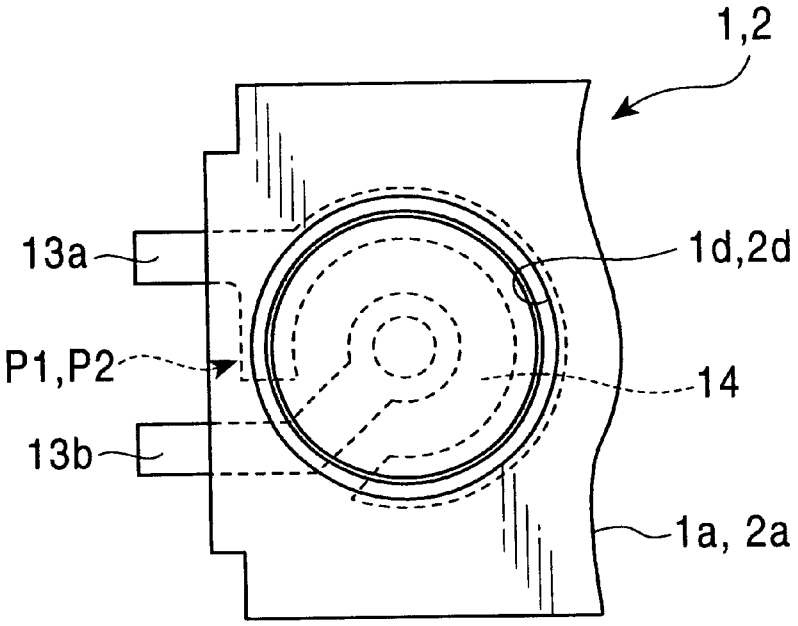
FIG. 11 is a plan view of an essential part of a push-switch of the multi-directional input device according to the present invention.
Figure 12:
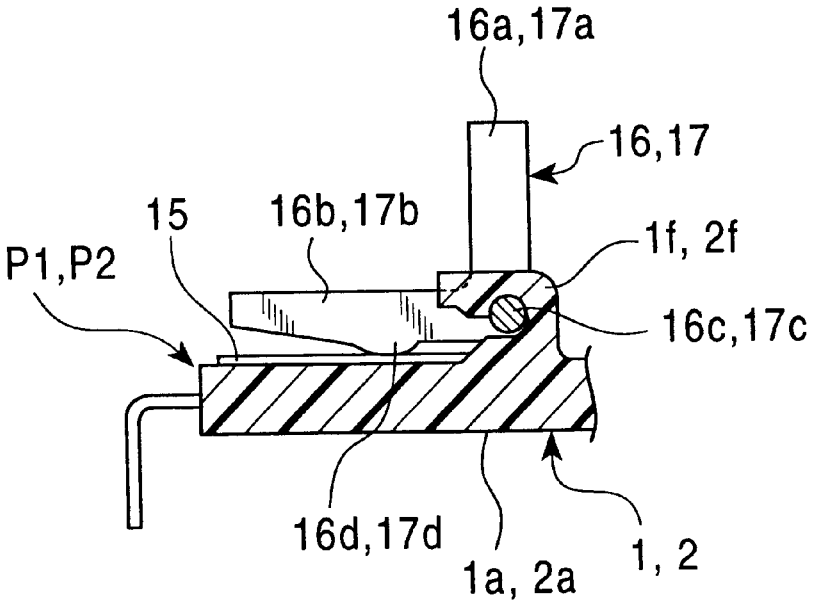
FIG. 12 is a sectional view of an essential part in the attached state of a movable member of the multi-directional input device according to the present invention.
Figure 13:
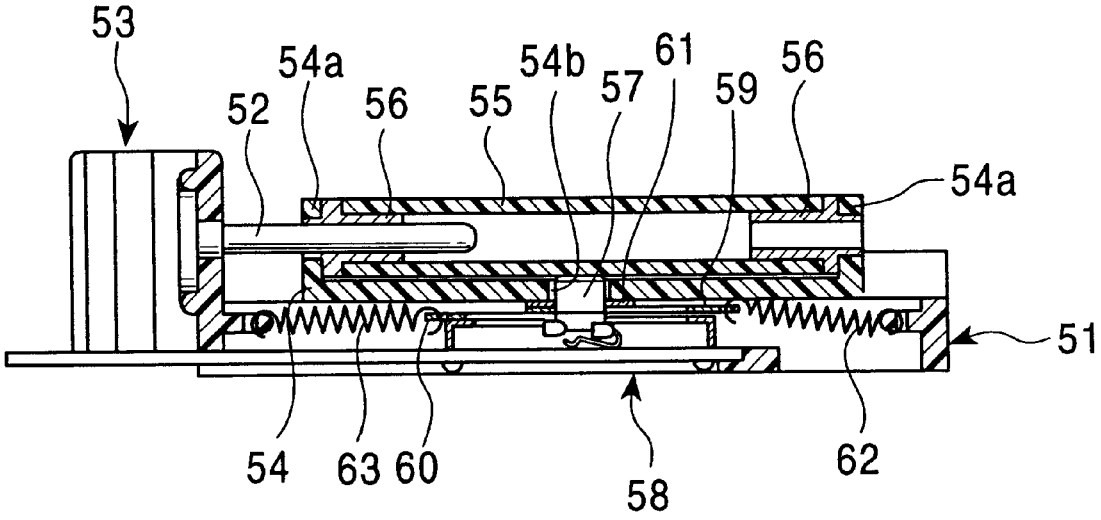
FIG. 13 PRIOR ART
FIG. 13 is a sectional view of an essential part of a conventional multi-directional input device.
Figure 14:
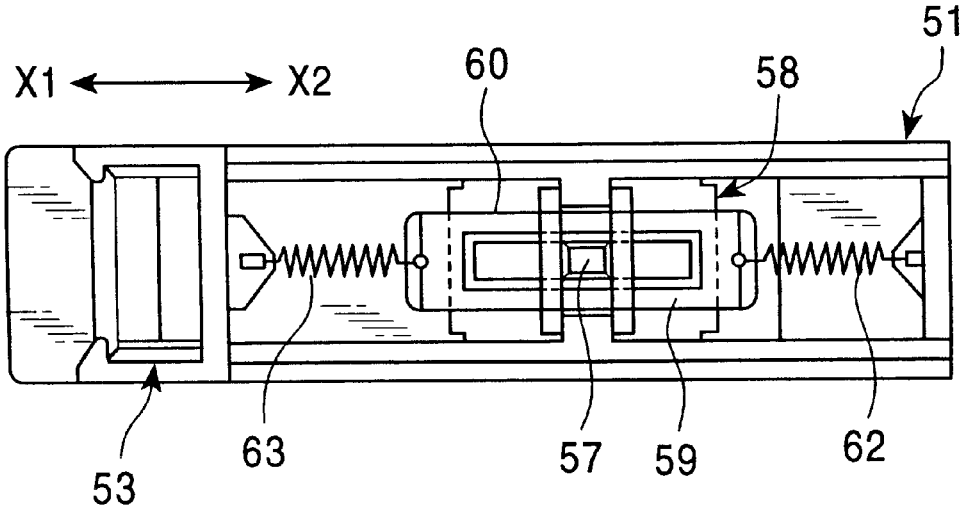
FIG. 14 PRIOR ART
FIG. 14 is a plan view for showing operation of a sliding type electrical element of the conventional multi-directional input device.
Figure 15:
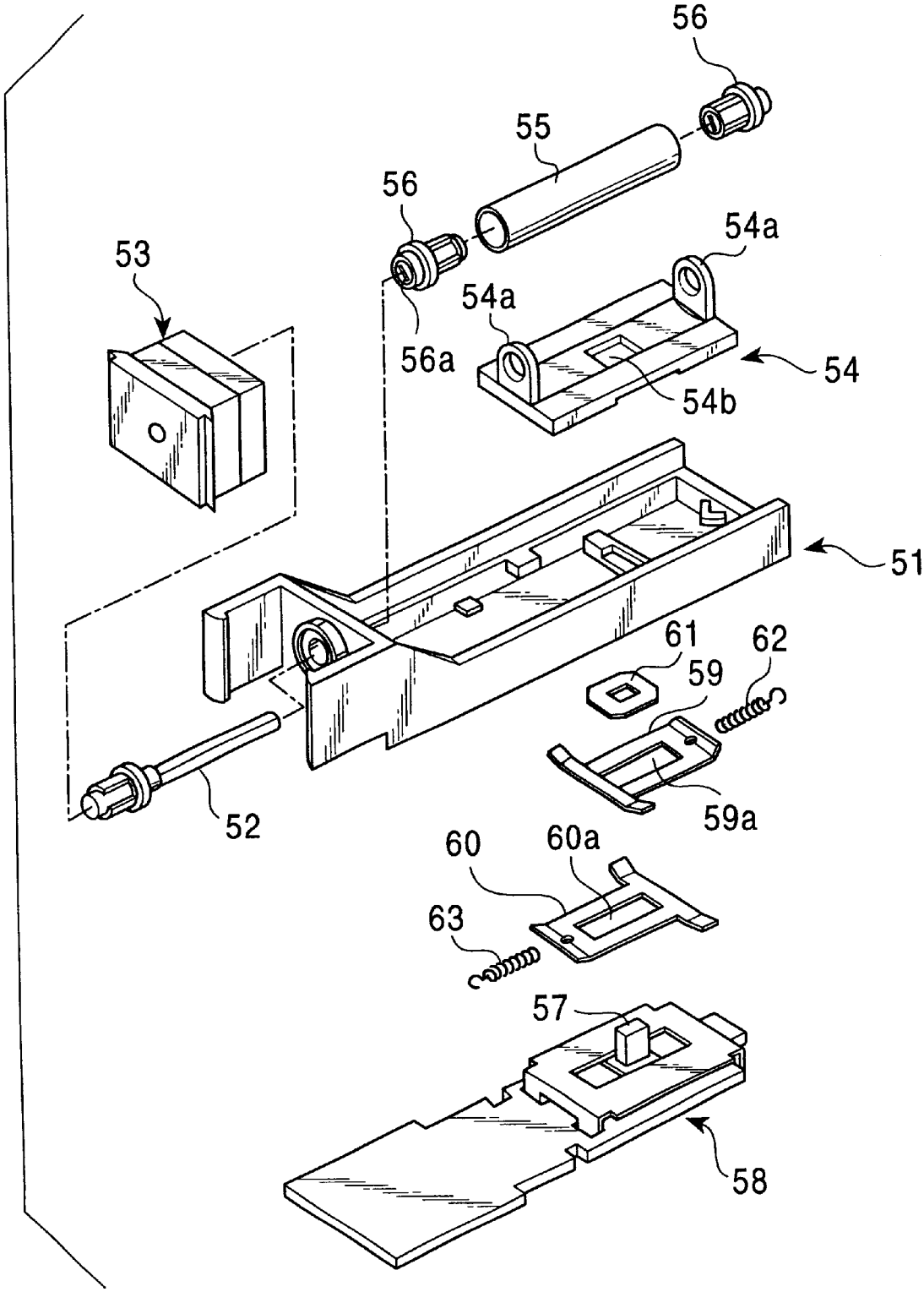
FIG. 15 PRIOR ART
FIG. 15 is an assembly view of the conventional multi-directional input device.

A multi-directional input device according to the present invention will be described with reference to FIGS. 1 to 12. Any of FIGS. 1 to 12 relates to the multi-directional input device according to the present invention: FIG. 1 is a plan view thereof; FIG. 2 is a sectional view of an essential part thereof; FIG. 3 is a sectional view at the line 3—3 of FIG. 1; FIG. 4 is a front view of a supporting member; FIG. 5 is a sectional view of an essential part of the supporting member in the attached state; FIG. 6 is a front view of a rotating member; FIG. 7 is a backside view of the rotating member; FIG. 8 is a side view of the rotating member; FIGS. 9 and 10 are schematic representations showing relationship between the supporting member and the rotating member; FIG. 11 is a plan view of an essential part of a push-switch; and FIG. 12 is a sectional view of an essential part of a movable member in the attached state.

Then the multi-directional input device according to the present invention is described with reference to FIGS. 1 to 12. Any of a pair of substantially T-shaped casing members 1 and 2 is formed of synthetic resin moldings. The casing member 1, which is one of the casing members 1 and 2, comprises a bottom wall 1*a*; a pair of supporting walls 1*c* vertically extending from the bottom wall 1*a* and spaced apart from each other, a pair of supporting walls 1*c*, each having a hole 1*b* formed therein for inserting a shaft; a recess 1*d* formed in the bottom wall 1*a*; a fitting hole 1*e* formed in the bottom wall 1*a*; and a pair of L-shaped fitting portions 1*f* spaced apart from each other.

The other casing member 2 also comprises a bottom wall 2*a*, a supporting wall 2*c* vertically extending from the bottom wall 2*a* and having a hole 2*b* formed therein for inserting a shaft; a recess 2*d* formed in the bottom wall 2*a*, a fitting hole 2*e* formed in the bottom wall 2*a*, a pair of L-shaped fitting portions 2*f* spaced apart from each other, and a through-hole 2*g* formed in the bottom wall 2*a* in the vicinity of the recess 2*d*.

A coupling member 3 formed of a metallic plate comprises a plate portion 3*a* and plural fitting legs 3*b* disposed from opposing ends of the plate portion 3*a* and arranged to oppose each other. The fitting legs 3*b* of the coupling member 3 are inserted into the fitting holes 1*e* and 2*e* of the casing members 1 and 2 so that the coupling member 3 unitarily combines two casing members 1 and 2 together by opening the end portions of the fitting legs 3*b*.

A roller-like operating member 4 formed of synthetic resin moldings, for example, comprises a roller-like operating portion 4*a* disposed in the center thereof and shafts 4*b* and 4*c* extending from both ends of the operating portion 4*a* in the axis direction of the center of the operating portion 4*a*.

The none-circular-columnar shaft 4*b*, which is one of shafts 4*b* and 4*c* of the operating member 4, is inserted into the holes 1*b* of the supporting walls 1*c* in the casing member 1 to be attached thereto while the other circular-columnar shaft 4*c* is inserted into the hole 2*b* of the supporting wall 2*c* in the casing member 2 to be attached thereto, so that the operating member 4 is rotatable and movable in the axis direction as well.

As shown in FIGS. 2 and 3, an actuation member 5 having a none-circular hole 5*a* in its center is formed of synthetic resin synthetic resin moldings, etc., to have the shape of a gear. The shaft 4*b* is inserted into the hole 5*a* in the state in that the actuation member 5 is placed between the pair of supporting walls 1*c* of the casing member 1, so that the actuation member 5 is arranged so as to rotate simultaneously together with the rotation of the operating member 4.

A movable contact 6 formed of a metallic plate and having the springing property is L-shaped as shown in FIG. 3. The movable contact 6 is press-fitted into the bottom wall 1*a* of the casing member 1 to be attached thereto while opposing a fixed contact 7 attached to the bottom wall 1*a*.

When the actuation member 5 is rotated, as shown in FIG. 3, the movable contact 6 is brought into and out of contact with the fixed contact 7 by reciprocating movement between the position shown by the solid line and the position shown by the dotted line owing to concave-convex portions of the actuation member 5 so as to generate an electrical signal that is a pulse signal.

That is, a rotary electrical element "K" generating an electrical signal is formed of the actuation member 5, the movable contact 6, and the fixed contact 7.

As shown in FIG. 4, a supporting member 8 formed of synthetic resin moldings comprises a base portion 8*b* having a recessed portion 8*a*; a hole 8*c* formed in the substantially central portion of the base portion 8*b*; a stopper 8*d* formed of a concave portion which is formed in a recessed wall of the base portion 8*b*; and a pair of projections 8*e* and a pair of retaining portions 8*f*, both pairs being formed beneath the base portion 8*b*.

A pair of fixed contacts 9*a* and 9*b* are embedded in the supporting member 8 and are exposed in the bottom of the recessed portion 8*a* so as to surround the hole 8*c*.

Such a supporting member 8 is attached to the casing member 2, as shown in FIG. 5, by retaining the retaining portions 8*f* on the bottom wall 2*a* so that the pair of projections 8*e* are inserted into holes (not shown) of the bottom wall 2*a* in the casing member 2.

Also, when the supporting member 8 is attached thereto, the shaft 4*a* penetrates the hole 8*c* while terminals of the fixed contacts 9*a* and 9*b* are protruding downwardly via the through-hole 2*g*.

As shown in FIGS. 6 to 8, a rotating member 10 is formed of a movable contact plate made of one metallic plate having movable contacts 10*a* and comprises a cylindrical portion 10*c* having a circular hole 10*b* formed in its center and a convex portion 10*d* formed in the outer periphery. As shown in FIGS. 9 and 10, the rotating member 10 is arranged within the recessed portion 8*a* of the supporting member 8, so that the movable contacts 1*a* are brought into and out of contact with the fixed contacts 9*a* and 9*b* while the convex portion 10*d* is positioned within a concave portion of the supporting member 8 so as to be able to abut the stopper 8*d*.

As shown in FIG. 2, such a rotating member 10 is attached by inserting the shaft 4*c* into the cylindrical portion 10*c*.

A circular-disc-shaped washer 11 formed of a synthetic resin, as shown in FIG. 2, is attached by fitting it to the shaft 4*c*. Also as shown in FIG. 2, the shaft 4*c* is inserted into an elastic member 12 formed of a rubber O-ring while the elastic member 12 is attached so as to be positioned on the cylindrical portion 10*c* of the rotating member 10.

When the elastic member 12 is attached, by elasticity of the elastic member 12, the movable contacts 10*a* are elastically urged to the fixed contacts 9*a* and 9*b* while the washer 11 is elastically urged to the supporting wall 2*c*; furthermore the cylindrical portion 10*c* of the rotating member 10 is elastically urged to the shaft 4*c* so that frictional force between the rotating member 10 and the shaft 4*c* is applied.

Then when the shaft 4*c* is rotated by rotating the operating portion 4*a*, the rotating member 10 is rotated in the normal or the reverse direction by frictional force between the shaft 4*c* and the rotating member 10.

When the rotating member 10 is rotated, as shown in FIGS. 9 and 10, it rotates together with the shaft 4*c* until the convex portion 10*d* of the rotating member 10 abuts the stopper 8*d* so as to generate a signal of the normal rotational direction or a signal of the reverse rotational direction by switching between the fixed contacts 9*a* and 9*b* "ON" and "OFF" with the movable contacts 10*a*. When the operating portion 4*a* is furthermore rotated, the rotating member 10 is stopped from rotation by the stopper 8*d*, so that the operating portion 4*a* starts to race.

That is, a switch "S" for detecting the rotational direction is formed of the movable contacts 10*a* provided in the rotating member 10 and the fixed contacts 9*a* and 9*b*.

As shown in FIGS. 2 and 11, a pair of fixed contacts 13*a* and 13*b* are embedded in the recesses 1*d* and 2*d* of the casing members 1 and 2 while a dome-shaped movable contact 14 is accommodated therein, which is prevented form coming out therefrom by the lid 15.

When the movable contact 14 is urged via the lid 15, the movable contact 14 is flipped to switch between the fixed contacts 13*a* and 13*b* "ON", and when urging is released, the movable contact 14 is flipped to the original position to switch between the fixed contacts 13*a* and 13*b* "OFF".

That is, first and second push-switches "P1" and "P2" formed of the movable contact 14 and the fixed contacts 13*a* and 13*b* are respectively formed in the casing members 1 and 2.

These first and second push-switches "P1" and "P2" are respectively arranged at both ends of the operating member 4 in the axial direction of the operating member 4 while are arranged outside the rotary electrical element "K" and the switch "S", that is, arranged in positions apart from the rotary electrical element "K" and the switch "S".

An L-shaped first movable member 16 formed of synthetic resin moldings comprises first and second arms 16*a* and 16*b*, a shaft 16*c* arranged in the side of the combining portion between the first and second arms 16*a* and 16*b*, and a convex portion 16*d* disposed in the bottom face of the second arm 16*b*, while an L-shaped second movable member 17 formed of synthetic resin moldings comprises first and second arms 17*a* and 17*b*, a shaft 17*c* arranged in the side of the combining portion between the first and second arms 17*a* and 17*b*, and a convex portion 17*d* disposed in the bottom face of the second arm 17*b*.

As is specifically shown in FIG. 12, the first and second movable members 16 and 17 are rotatably attached by hooking the shafts 16*c* and 17*c* on the pair of L-shaped fitting portions 1*f* and 2*f* arranged in the casing members 1 and 2, respectively.

When the movable member 16, which is one of the movable members 16 and 17, is attached in such a manner, the first arm 16*a* opposes the shaft 4*b* protruding from the supporting walls 1*c* while the convex portion 16*d* of the second arm 16*b* opposes the lid 15 on the movable contact 14, so that the convex portion 16*d* is urged by the springing property of the movable contact 14, thereby the first arm 16*a* is abutting on the shaft 4*b*.

When the other movable member 17 is attached, the first arm 17*a* opposes the shaft 4*c* protruded from the supporting member 8 while the convex portion 17*d* of the second arm 17*b* opposes the lid 15 on the movable contact 14, so that the convex portion 17*d* is urged by the springing property of the movable contact 14, thereby the first arm 17*a* is abutting on the shaft 4*c*.

Next, operation of the multi-directional input device having such a structure will be described. In FIG. 2, when the operating member 4 is moved in the axial direction indicated by the arrow "A1", the shaft 4*b* urges the first arm 16*a* of the first movable member 16 against the springing property of the movable contact 14 in the first push-switch Thereby, the first movable member 16 is rotated about the shaft 16*c* so that the convex portion 16*d* of the second arm 16*b* urges the top of the movable contact 14 so as to flip it; thereby, the fixed contacts 13*a* and 13*b* are brought into conduction to switch the first push-switch "P1" "ON".

At this time, the second push-switch "P2" maintains the "OFF" state because the second movable member 17 is not urged.

Then when the movement of the operating member 4 in the direction of the arrow "A1" is cancelled, the movable contact 14 is flipped to the original position, so that the first push-switch "P1" is switched "OFF", while the second arm 16*b* is pushed back by the flipping operation of the movable contact 14, so that the first arm 16*a* pushes back the shaft 4*b*, thereby returning the operating member 4 to the neutral position as shown in FIG. 2.

Then when the operating member 4 is moved in the axial direction indicated by the arrow "A2", the shaft 4*c* urges the first arm 17*a* of the second movable member 17 against the springing property of the movable contact 14 in the second push-switch "P2".

Thereby, the second movable member 17 is rotated about the shaft 17*c* so that the convex portion 17*d* of the second arm 17*b* urges the top of the movable contact 14 so as to flip it; thereby, the fixed contacts 13*a* and 13*b* are brought into conduction to switch the second push-switch "P2" "ON".

At this time, the first push-switch "P1" maintains the "OFF" state because the first movable member 16 is not urged.

Then when the movement of the operating member 4 in the direction of the arrow "A2" is cancelled, the movable contact 14 is flipped to the original position, so that the second push-switch "P2" is switched "OFF", while the second arm 17*b* is pushed back by the flipping operation of the movable contact 14, so that the first arm 17*a* pushes back the shaft 4*c*, thereby returning the operating member 4 to the neutral position as shown in FIG. 2.

When such a multi-directional input device is used in a portable telephone, such an application is possible, in which when the first push-switch "P1" is operated, for example, the display frame is sequentially scrolled up from downward frame-by-frame while when the second push-switch "P2" is operated, the display frame is sequentially scrolled down from upward frame-by-frame.

Next, in FIG. 2, when the operating member 4 is rotated in the normal direction of the arrow "B1", the rotating member 10 rotates together therewith by the frictional force between the shaft 4*c* and the rotating member 10 until it abuts the stopper 8*d*, as shown in FIG. 9.

Consequently, the movable contact 10*a* brings the fixed contacts 9*a* and 9*b* into conduction so as to switch them "ON" and generates a rotational signal in the normal direction by the switch "S" while when the operating member 4 is continued to rotate in the direction of the arrow "B1", the operating member 4 races while maintaining the "ON" state.

On the other hand, the actuation member 5 is rotated via the shaft 4*b* by following rotation of the operating member 4, so that the movable contact 6 repeats to bring into and out of contact with the fixed contact 7 to generate a pulse signal, thereby a signal of rotational quantity is generated by the rotary electrical element "K".

Next, in FIG. 2, when the operating member 4 is rotated in the reverse direction of the arrow "B2", just as described above, the rotating member 10 rotates together therewith by the frictional force between the shaft 4*c* and the rotating member 10 until it abuts the stopper 8*d*, as shown in FIG. 10.

Consequently, the movable contact 10*a* brings the fixed contacts 9*a* and 9*b* out conduction so as to switch them "OFF" and generates a rotational signal in the reverse direction by the switch "S" while when the operating member 4 is continued to rotate in the direction of the arrow "B2", the rotating member 10 races while maintaining the "OFF" state.

On the other hand, the actuation member 5 is rotated via the shaft 4*b* by following rotation of the operating member 4, so that the movable contact 6 repeats to bring into and out of contact with the fixed contact 7 to generate a pulse signal, thereby a signal of rotational quantity is generated by the rotary electrical element "K".

When such a multi-directional input device is used in a portable telephone, such an application is possible, in which when the operating member 4 is rotated in the normal direction of the arrow "B1", for example, the display cursor position exhibited on the display is sequentially changed up from downward while when the operating member 4 is rotated in the reverse direction of the arrow "B2", the display cursor position exhibited on the display is sequentially changed down from upward.

In such a manner, the multi-directional input device is operated.

In addition, in the embodiment mentioned above, the switch "S" is described as having two fixed contacts 9*a* and 9*b*; however, it may have not less than three fixed contacts. Also, the fixed contacts 9*a* and 9*b* are described as being disposed in the supporting member 8; however they may be disposed in a vertical wall which may be formed in the casing member 2.

The stopper 8*d* is also described as being formed in the supporting member 8; however, it may be formed in the casing member 2, and the push-switch may be only one.

When the L-shaped movable members 16 and 17 are used, spaces in the corner portions thereof are available for arrangement of different elements, which is effective for devices to which miniaturizing and a thin shape are specifically demanded.

In the multi-directional input device according to the present invention, since the push-switch "P1" operated by the movement in the axial direction of the operating member 4 to generate an electrical signal is arranged at the end of the operating member 4 in the axial direction, the thickness can be reduced thereby providing a multi-directional input device having a thin shape.

The operating member 4 comprises the operating portion 4*a* disposed in the center thereof and the shafts 4*b* and 4*c* disposed at the ends of the operating portion 4*a*, and the operating member 4 is rotatably supported at the shafts 4*b* and 4*c* by the casing members 1 and 2 while the push-switch "P1" is operated via the shaft 4*b*, so that a large number of parts are not required as in a conventional one thereby providing a multi-directional input device at a low cost and with excellent efficiency in assembling.

Since the operating portion 4*a* is arranged nearer to the rotary electrical element "K" than the push-switch "P1", the shaft 4*b* of the operating member 4 is used to operate both the rotary electrical element "K" and the push-switch "P1" as a combined use, thereby providing a compact multi-directional input device having a small number of parts.

Also, in the casing members 1 and 2, the bottom walls 1*a* and 2*a* are formed to attach the push-switch "P1" to the bottom wall 1*a*, thereby providing a thin multi-directional input device in that the push-switch "P1" can be simply attached.

The L-shaped movable member 16 having the first and second arms 16*a* and 16*b* is rotatably held so that the shaft 4*b* urges the first arm 16*a* so as to rotate the movable member 16, and the push-switch "P1" is operated with the second arm 16*b* by the rotation of the movable member 16, thereby providing a multi-directional input device with excellent productivity having the push-switch "P1" which is simple in the structure and operation.

By using the L-shaped movable member 16, a space in the corner portion thereof is available for arrangement of different elements so as to be effective for devices to which miniaturizing and a thin shape are specifically demanded.

The push-switches "P1" and "P2" are respectively arranged at both ends of the operating member 4, so that the push-switches "P1" and "P2" are respectively operated by the movement of the operating member 4 in the axial direction, thereby providing a thin multi-directional input device which is readily operational and has excellent operability while in which plural push-switches "P1" and "P2" can be compactedly arranged.

The switch "S" for detecting the rotational direction and, which is operated by the rotation of the operating member 4, is arranged at one end of the operating member 4 while the rotary electrical element "K" is arranged at the end of the operating member 4, thereby providing a multi-directional input device, which is specifically suitable for use in portable telephones, while in which numerous input members can be compactedly arranged by making them thinner.

In the multi-directional input device according to the present invention, since the push-switches "P1" and "P2" are arranged at ends of the operating member 4 in the axial direction while the rotating member 10 of the rotary electrical element "K" is held by the shaft 4*c* of the operating member 4 to be rotated together with the shaft 4*c* by frictional force during the rotation of the shaft 4*c*, and after the rotation together therewith at a predetermined angle, the rotating member 10 is stopped from rotating by the stopper 8*d* to cause the shaft 4*c* to race, thereby generating rotational signals in the normal and reverse directions, the dimension in the thickness direction can be reduced while the rotating member 10 can be settled only by fitting it to the shaft 4*c*, thereby providing a multi-directional input device with excellent efficiency in assembling and at a lower cost.

Also, the rotating member 10 is coaxially attached to the shaft 4*c* enabling the size in the radial direction to be reduced, thereby providing a thin multi-directional input device.

Also, by forming the stopper in the casing member 2, a multi-directional input device having a simple structure can be provided at a low cost.

Also, the concave portion is formed in the casing member 2 to form the stopper while the convex portion 10*d* is formed in the rotating member 10 so as to stop the rotation of the rotating member 10 by the abutment of the convex portion 10*d* on part of the concave portion, thereby providing a multi-directional input device in that the structure is simple and productivity is excellent while the rotating member 10 can be securely stopped from rotation.

The fixed contacts 9*a* and 9*b* are provided in the supporting member 8 formed of an insulating material which is attached to the casing member 2, so that the supporting member 8 can be appropriately applied corresponding to the shape of the fixed contact, thereby providing a flexible multi-directional input device.

Also, the stopper 8*d* is formed in the supporting member 8, so that the supporting member 8 and the rotating member 10 can be assembled in the combined state therebetween, thereby providing an inexpensive multi-directional input device having excellent productivity.

Also, the concave portion is formed in the casing member 2 to form the stopper while the convex portion 10*d* is formed in the rotating member 10 so as to stop the rotation of the rotating member 10 by the abutment of the convex portion 10*d* on part of the concave portion, thereby providing a multi-directional input device in that the structure is simple and productivity is excellent while the rotating member 10 can be securely stopped from rotation.

Since frictional force is applied between the rotating member 10 and the operation member 4 by the elastic member 12, the generator is simple in the structure and excellent in productivity while only a small space is needed therefor, thereby providing a small-sized multi-directional input device.

Since the rotating member 10 is formed of a movable contact plate made of one metallic plate having the movable contacts 10*a*, thereby providing an inexpensive multi-directional input device which has a small number of parts and is simple in the structure and excellent in productivity.

The operating member 4 comprises a roller-like operating portion 4*a* disposed in the center thereof and shafts 4*b* and

4*c* disposed at both ends of the operating portion 4*a*, so that the rotary electrical element "K" is arranged at the end of the shaft 4*b* while the switch "S" is arranged at the end of the shaft 4*c*, thereby providing a thin multi-directional input device.

What is claimed is:

1. A multi-directional input device comprising:

a casing member;

a roller-like operating member, which is rotatable and movable in an axial direction and supported by said casing member;

a rotary electrical element, which generates an electrical signal and is operated by rotation of the operating member; and a push-switch operated by the movement in the axial direction of the operating member, wherein said rotary electrical element and said push-switch are arranged at an end of the operating member in the axial direction, and wherein the operating member comprises an operating portion disposed at a center of the operating member and a shaft provided at an end of the operating member so that the operating member is rotatably held at the shaft by said casing member while said rotary electrical element and said push-switch are operated via the shaft, and further comprising an L-shaped movable member rotatably held and having a first arm and a second arm, wherein the shaft urges the first arm so as to rotate said movable member so that said push-switch is operated with the second arm by the rotation of said movable member.

2. A multi-directional input device according to claim 1, wherein the operating portion is arranged nearer to said rotary electrical element than to said push-switch.

3. A multi-directional input device according to claim 1, wherein said casing member is provided with a bottom wall to which said push-switch is attached.

4. A multi-directional input device according to claim 1, wherein the push-switch is arranged at one end of the operating member and a second push-switch is arranged at a second end of the operating member so that each push-switch is respectively operated by the movement in the axial direction of the operating member.

5. A multi-directional input device according to claim 4, further comprising a switch for detecting the rotational direction operated by the rotation of the operating member, wherein said switch is arranged at one end of the operating member while said rotary electrical element is arranged at the second end of the operating member.

6. A multi-directional input device comprising:

a casing member;

a shaft;

an operating member rotatably attached to said casing member;

a rotary electrical element for generating an electrical signal by rotation of said operating member;

a rotating member held by said shaft and formed to rotate together with said shaft by frictional force during the rotation of said shaft due to the rotation of said operating member and to be stopped from rotating by a stopper so as to cause said shaft to race after rotating together therewith at a predetermined angle;

a switch formed of a movable contact provided in said rotating member and a fixed contact attached to said casing member; and a push-switch, wherein after the movable contact switches the fixed contact by the rotation of said rotating member in the normal or reverse direction when said operating member is rotated in the normal or reverse direction, said rotating member abuts the stopper to thereby operate said switch so that the rotating member stops rotating and said operating member starts to race, wherein said rotary electrical element is operated to generate an electrical signal by rotation of said operating member, and wherein said push-switch is arranged at an end of said operating member in a axial direction so that said push-switch is operated to generate an electrical signal by the movement of said operating member in the axial direction.

7. A multi-directional input device according to claim 6, wherein the stopper is formed in said casing member.

8. A multi-directional input device according to claim 7, wherein a concave portion is formed in said casing member to form the stopper therein while a convex portion is formed in said rotating member to cause the convex portion to abut part of the concave portion so as to stop the rotation of said rotating member.

9. A multi-directional input device according to claim 6, further comprising a supporting member made of an insulating material and provided with the fixed contact, wherein the fixed contact is attached to said casing member by attaching said supporting member to said casing member.

10. A multi-directional input device according to claim 9, wherein the stopper is formed in said supporting member.

11. A multi-directional input device according to claim 10, wherein a concave portion is provided in said supporting member to form the stopper while a convex portion is provided in said rotating member so that rotation of said rotating member is stopped by abutting of the convex portion to part of the concave portion.

12. A multi-directional input device according to claim 6, further comprising an elastic member, wherein frictional force between said rotating member and said operating member is applied by said elastic member.

13. A multi-directional input device according to claim 6, further comprising a movable contact plate formed of one metallic plate and provided with the movable contact, wherein said rotating member is formed of said movable contact plate.

14. A multi-directional input device according to claim 6, wherein said operating member comprises a roller-like operating portion disposed at a center of said operating member and the shaft is disposed at a first end and a second end of said operating member, said rotary electrical element being arranged at the shaft at the first end of the operating member while said switch is arranged at the shaft at the second end of the operating member.

* * * * *